US005159735A

United States Patent [19]

Owens et al.

[11] Patent Number: 5,159,735

[45] Date of Patent: Nov. 3, 1992

[54] DEVICE FOR CLEANING TOILET SEATS

[76] Inventors: Dolores Owens, 3967 Bellview St., Metairie, La. 70002; Evelyn Cory, 968 W. Seventh St., Upland, Calif. 91786

[21] Appl. No.: 586,799

[22] Filed: Sep. 24, 1990

[51] Int. Cl.[5] ..... A47L 13/17

[52] U.S. Cl. ..... 15/104.94; 15/244.1; 15/210.1; 206/205

[58] Field of Search ..... 15/104.93, 104.94, 210 R, 15/209 R, 209 E, 244.1, 244.4; 206/205

[56] References Cited

U.S. PATENT DOCUMENTS

| | | | |
|---|---|---|---|
| 3,242,519 | 3/1966 | Murray | 15/210 R X |
| 4,575,891 | 3/1986 | Valente | 15/210 R X |
| 4,925,453 | 5/1990 | Kannankeril | 15/104.94 X |
| 4,998,984 | 3/1991 | McClendon | 206/205 |

FOREIGN PATENT DOCUMENTS

| | | | |
|---|---|---|---|
| 200346 | 7/1923 | United Kingdom | 15/210 R |

*Primary Examiner*—Edward L. Roberts
*Attorney, Agent, or Firm*—Alexander Plache

[57] ABSTRACT

A hand-held disposable device specifically designed and constructed to permit the effective and efficient cleaning of toilet seats. In a preferred embodiment, the device comprises a support means, a handle mounted thereon, and an absorbent fabric material impregnated with a fast-drying liquid chemical cleaning, disinfecting, anti-bacterial, anti-viral or anti-fungal agent or a combination thereof. In another embodiment, said device being wrapped or packaged in a material impervious to said liquid chemical agent so as to prevent evaporation or drying of the chemical substance impregnated in the fabric and to contain the agent prior to use.

12 Claims, 2 Drawing Sheets

DEVICE FOR CLEANING TOILET SEATS

BACKGROUND, OBJECTS AND SUMMARY OF THE INVENTION

The present invention relates to a hand-held, disposable device designed and constructed in such a manner as to enable the effective and efficient cleaning and disinfecting of toilet seats. It is, therefore, the object of the invention to permit such cleaning and disinfecting of toilet seats prior to their use. The device is specifically designed and constructed to be both portable and disposable. Furthermore, the invention is designed to enable use in a sanitary manner without the user having to come into direct contact with the liquid agent or the toilet seat during the cleaning operation. In a preferred embodiment, the device contains an absorbent material impregnated with a fast-drying liquid chemical cleaner, disinfectant, anti-bacterial, anti-viral or anti-fungal agent, or combination thereof, so as to effectuate the killing of germs, bacteria, viruses or the like which may be located on the toilet seat. In another embodiment, the device is pre-packaged in a non-woven material in such a manner that the packaging material forms a shield between the support means and handle of the device when the package is opened prior to use. Said packaging material is specifically designed so as to be impervious to the liquid chemical agent and to prevent evaporation or drying of the chemical agent with which the fabric portion of the device is impregnated.

It is a further object of the instant invention to conform easily to the configuration of the surface of a typical toilet seat, the device being designed to be used by placing the device on the toilet seat and then manually moving it in a circular fashion around the surface of the seat. When used, a particular embodiment of the device causes a liquid chemical cleaner, disinfectant, anti-bacterial, anti-viral or anti-fungal agent, or a combination thereof, to be transferred to or deposited on the surface of the toilet seat. The liquid chemical agent used to impregnate the absorbent fabric is selected so as to be relatively fast drying, specifically having a rate of drying such that the agent is at least ninety percent evaporated within five minutes after application.

Prior to the instant invention, no inexpensive, portable, easily carried and disposable device was known which was exclusively designed for the purpose of cleaning toilet seats. The configuration of the instant invention renders it particularly well suited to accomplish its intended purpose in an effective and efficient manner. In a preferred embodiment, the device is comprised of a support means to one surface of which a handle is attached and to the opposite surface of which an absorbent fabric material capable of impregnation with a fast-drying liquid chemical cleaning, disinfecting, anti-bacterial or anti-fungal agent, or combination thereof is affixed in an appropriate manner. A vast number of such fast-drying chemical agents are known to exist exhibiting the properties necessary to carry out the purpose of the invention, i.e., to enable the cleaning of a toilet seat in a short period of time with the agent evaporating or drying within five minutes of the use of the invention.

Although various cleaning devices are known which can be used to clean toilet seats, none of these is specifically designed for this purpose nor has a configuration even remotely resembling the instant invention. The device is designed so as to be light-weight and portable so as to be capable of being easily carried in a purse, pocketbook or even in a jacket or pants pocket by a person desiring to use the device. The device is also susceptible to placement in vending machines located in public restrooms.

In a particular embodiment, the invention is packaged or wrapped in a non-woven material so that, in addition to preventing the premature evaporation or drying of the chemical cleaning, disinfecting, anti-bacterial or antifungal chemical agent, or combination thereof, prior to use, the packaged device can be carried or otherwise handled without the chemical agent coming into contact with anything outside of the package prior to the opening of the package just prior to use.

The present invention is also designed to be susceptible to inexpensive and efficient manufacture. The device is designed to be disposed after one use and is capable of being sold individually or in packages containing a number of the individually-packaged devices.

Other devices currently available which can be used for the purpose described herein and which have been impregnated or pre-moistened with a cleaning or disinfecting agent, do not contain a feature wherein they can be used without the user's hands coming into contact with the agent unless gloves are worn. Pre-moistened wipes presently commercially available illustrate this problem. No currently available device is uniquely designed to accomplish its intended purpose in the manner described herein. The instant invention, however, enables the user to use the device for its intended purpose without coming into contact with the chemical agent.

PRIOR ART

A patentability search conducted in this matter has revealed the following patents, none of which relate to a device specifically designed to enable the cleaning of toilet seats in the manner of the instant invention described herein:

| | |
|---|---|
| 1,351,311 | Virnebrug |
| 2,029,626 | Lierley |
| 2,234,670 | Fiandach |
| 2,345,730 | Cox |
| 2,607,940 | Miller |
| 2,811,767 | Dufford |
| 2,855,622 | Tixerant |
| 2,924,049 | Spain |
| 3,611,468 | Michael |
| 4,051,572 | Greenwood |
| 4,065,826 | Hough |
| 4,071,921 | Jury |
| 4,347,931 | Ginger, et al |
| 4,454,624 | Vandermer |
| 4,621,388 | Ortolivo |
| 4,645,251 | Jacobs |

All of the above patents relate to inventions or devices which are clearly distinguishable from the instant invention.

DETAILED DESCRIPTION OF A PREFERRED EMBODIMENT OF THE DEVICE

Figure 1:
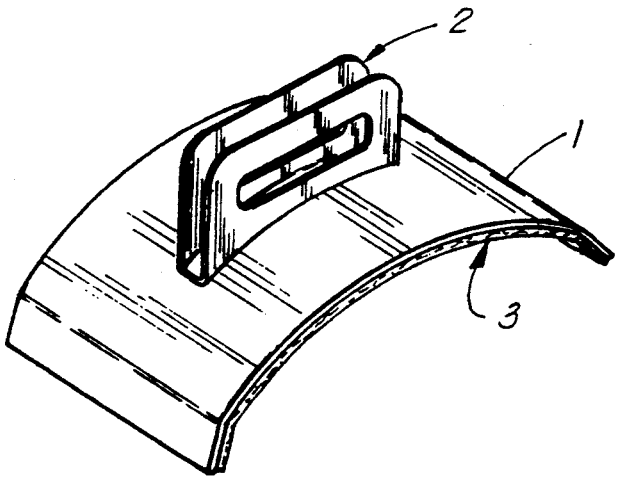
FIG. 1 illustrates one embodiment of the invention comprising a support means 1, a handle 2 and absorbent fabric material 3 susceptible to impregnation with a fast-drying chemical cleaner, disinfectant, anti-bacterial, anti-viral or anti-fungal agent, or combination thereof, said absorbent fabric being attached to the opposite surface of the support means 1 from the surface on which the handle 2 is attached.
Figure 6:
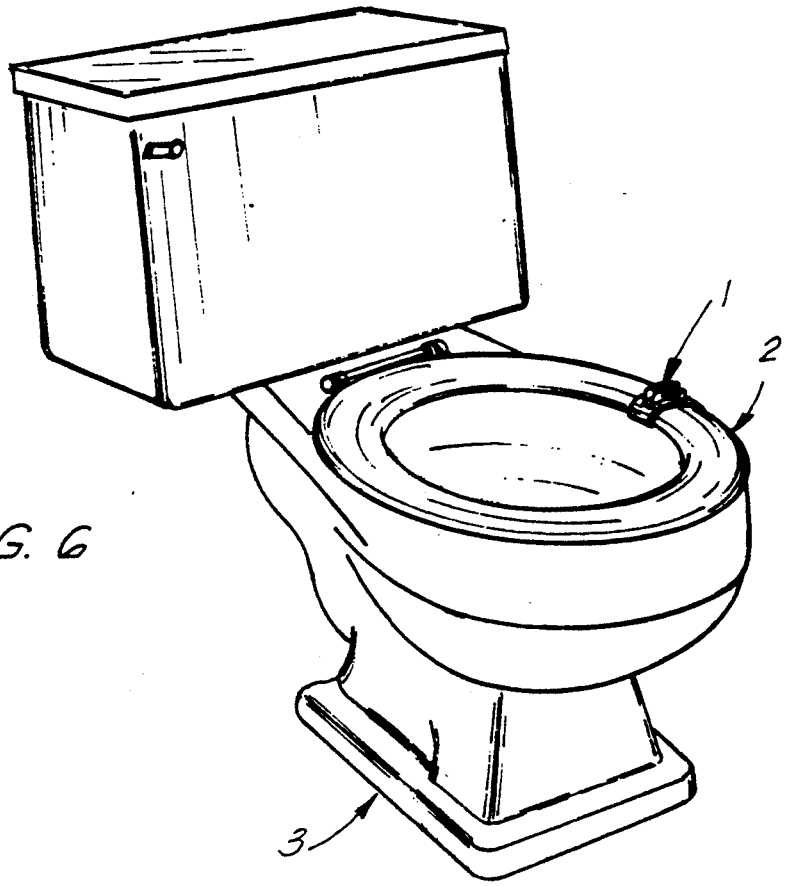
FIG. 6 shows how the device is used on a typical toilet seat.

A preferred embodiment of the invention is shown in FIG. 1. As illustrated, the device consists of a flexible shell or support means 1 designed and constructed to conform with a typical toilet seat, said support means or shell having a handle 2 affixed to one surface thereof and having a thin layer of absorbent fabric 3 affixed to the opposite surface of said support means or shell. As shown, the support means or shell 1 is curved in such a manner as to conform more easily and effectively with the surface of a typical toilet seat which the device is designed to clean. It is the absorbent fabric which, in a particular embodiment of the invention, is impregnated with a fast-drying liquid chemical cleaning, disinfecting, anti-bacterial, anti-viral or anti-fungal agent, or combination thereof, which is deposited on or transferred to the toilet seat during use of the device. The handle 2 and support means or flexible shell 1 allow the user to exert a moderate downward force on the device while using the device by moving it around the approximately circular surface of the toilet seat once the device is positioned on the toilet seat as shown in FIG. 6.

Figure 2:
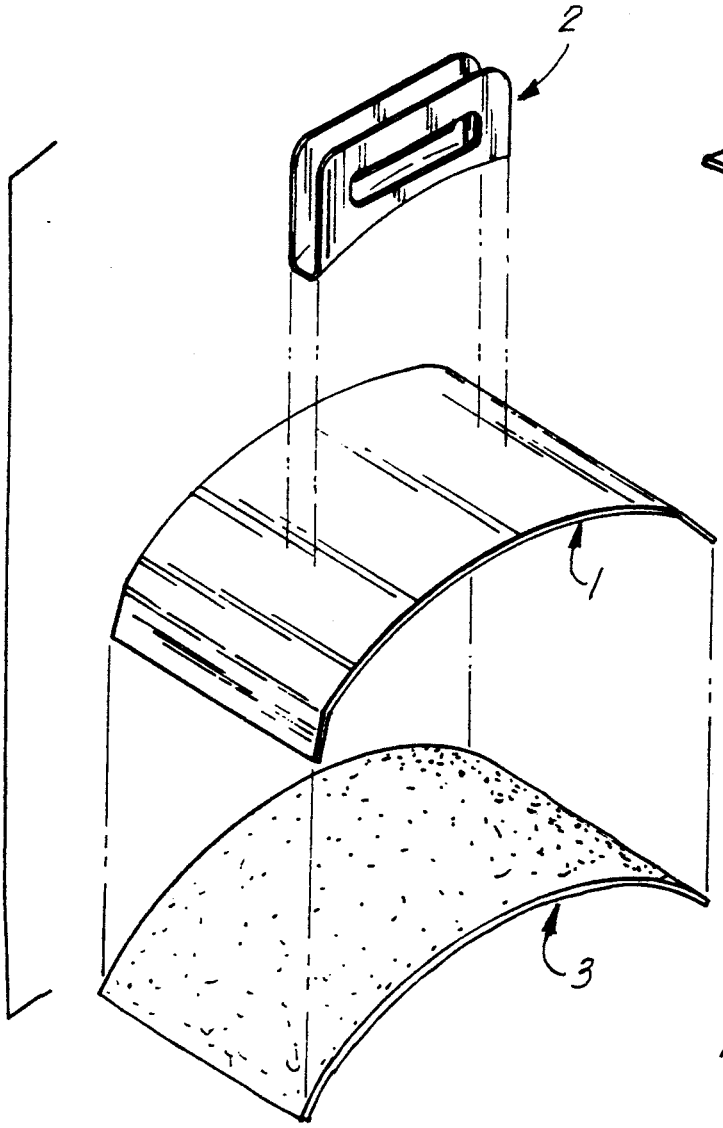
FIG. 2 depicts the individual components which are combined to form the instant invention.

FIG. 2 further illustrates the individual components of the invention consisting of the flexible shell or support means 1, a handle 2, and a layer of absorbent fabric 3. Again, it is the absorbent layer of fabric which is impregnated with the liquid chemical agent.

Figure 3:
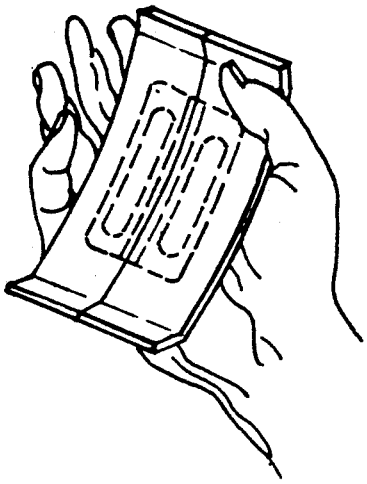
FIG. 3 depicts an embodiment of the device wherein the invention is packaged in a wrapper or packaging material which is impervious to the liquid chemical agent with which the absorbent fabric is impregnated so as to render the device capable of being handled without the liquid chemical agent coming into contact with the handler.

Prior to use, a particular embodiment of the device is encased in an appropriate packaging material in such a manner as to allow the device to be easily carried and to prevent the liquid chemical agent from coming into contact with anything outside of said packaging material. This is substantially shown in FIG. 3.

Figure 4:
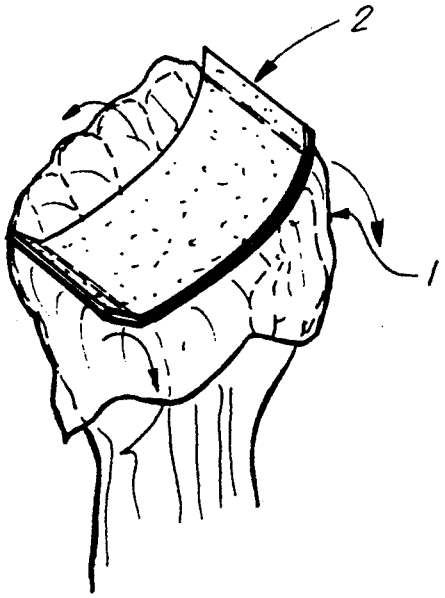
FIG. 4 shows an embodiment of the invention wherein the packaging material 1, when opened, forms a barrier or shield between the handle and support means 2 of the device thereby comprising an additional safety feature to further ensure that the chemical agent does not come into contact with the user.

FIG. 4 depicts an embodiment of the invention once the packaging material is open. As can be seen in the embodiment illustrated by FIG. 4, the packaging material 1 forms a protective shield or barrier between the shell or support means and absorbent fabric material containing the liquid chemical agent 2 and the handle of the device and the user's hand 3, thereby reducing the possibility of the users coming into contact with said chemical agent.

Figure 5:
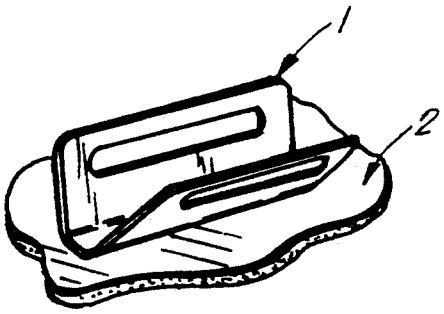
FIG. 5 depicts the handle of the device as it exists in a particular embodiment of the invention, illustrating the manner in which the material forming said handle can be folded or manipulated in such a way as to form a handle prior to use.

FIG. 5 shows an embodiment of the handle of the device 1 as it is attached or affixed to the shell of the device 2 in such a manner that, while packaged, the handle lies flat, flush or essentially parallel to the surface of the shell, but which can be bent, folded or creased in two locations as depicted in FIG. 5 to form a handle prior to use.

FIG. 6 illustrates the device 1 as it sits on the seat 2 of a typical toilet 3. During use, the device is moved along the approximately circular surface of the toilet seat, thereby depositing or transmitting the liquid chemical agent to the seat. Additionally, during use, the user can exert a moderate downward force on the device so as to ensure more effective and complete cleaning of the surface of the toilet seat. The liquid chemical agent with which the absorbent fabric component of the invention is impregnated is deposited on the surface of the toilet seat during use of the device thereby cleaning and/or disinfecting the seat. Because of the quick-drying nature of the liquid chemical agent with which the absorbent fabric is impregnated, the seat can be utilized shortly after the device is used (typically within two or three minutes if an appropriately quick-drying chemical agent is used).

What is claimed is:

1. A device for cleaning toilet seats comprising a hand-holdable curved shaped support means, said support means having a face (, said face having) with at least one dimension substantially as wide as the annular width of a toilet seat, said face further being made of a flexible material which curves in a manner to conform with the curved top surface of a toilet seat and further comprising absorbent material attached to and substantially covering said face.

2. The device of claim one wherein said support means includes a handle or other means of holding the device during use, said handle being attached to the opposite side of the face on which the absorbent fabric is affixed.

3. The device of claim one wherein the absorbent fabric is impregnated with a fast-drying liquid cleaning agent.

4. The device of claim one wherein the absorbent fabric is impregnated with a fast-drying liquid cleaning agent which has the property of substantially evaporating or drying in a time period of less than five minutes.

5. The device of claim one wherein the absorbent fabric is impregnated with a fast-drying liquid chemical disinfectant.

6. The device of claim one wherein the absorbent fabric is impregnated with a fast-drying liquid chemical disinfectant which has the property of evaporating or drying in a period of not more than three minutes.

7. The device of claim one wherein the absorbent fabric is impregnated with a fast-drying liquid anti-bacterial agent.

8. The device of claim one wherein the absorbent fabric is impregnated with a fast-drying liquid anti-bacterial agent which has the property of substantially evaporating or drying in a time period of less than five minutes.

9. The device of claim one wherein the absorbent fabric is impregnated with a fast-drying liquid anti-viral agent.

10. The device of claim one wherein the absorbent fabric is impregnated with a fast-drying liquid anti-viral agent which has the property of substantially evaporating or drying in a time period of less than five minutes.

11. The device of claim 1 wherein the absorbent fabric is impregnated with a fast-drying liquid anti-fungal agent.

12. The device of claim 1 wherein the absorbent fabric is impregnated with a fast-drying liquid anti-fungal agent which has the property of substantially evaporating or drying in a time period of less than three minutes.

* * * * *